United States Patent [19]

Kalko et al.

[11] 3,938,537

[45] Feb. 17, 1976

[54] METHOD OF PREPARING LIQUID MIXTURES OF PREDETERMINED COMPOSITION

[75] Inventors: Jürgen Kalko; Wolfgang Crull, both of Heilbronn a. N., Germany

[73] Assignee: Lucca GmbH, Heilbronn a. N., Germany

[22] Filed: Nov. 4, 1974

[21] Appl. No.: 520,915

Related U.S. Application Data

[63] Continuation of Ser. No. 353,723, April 23, 1973, abandoned.

[30] Foreign Application Priority Data

Apr. 25, 1972 Germany ..... 2220224

[52] U.S. Cl. ..... 137/14; 137/205; 426/477

[51] Int. Cl.[2] ..... B01F 15/04

[58] Field of Search ..... 137/7, 12, 12.5, 14, 205, 137/241; 141/59, 60, 61; 426/365, 474, 477

[56] References Cited

UNITED STATES PATENTS 3,336,767 8/1967 Mackenzie et al. ..... 137/205 X

*Primary Examiner*—Alan Cohan
*Assistant Examiner*—Gerald A. Michalsky
*Attorney, Agent, or Firm*—Ernest G. Montague; Karl F. Ross; Herbert Dubno

[57] ABSTRACT

A method of preparing liquid mixtures of predetermined composition, particularly beverages, which comprises the steps of dosing components of the liquid mixture on the basis of weight and evacuating a mixing container to a pressure of less than 0.5 atm. abs. Then individual components of the liquid mixture are drawn into the mixing container by means of valves controlled in succession in dosing devices from storage containers which are under higher pressure than the mixing container.

1 Claim, 1 Drawing Figure

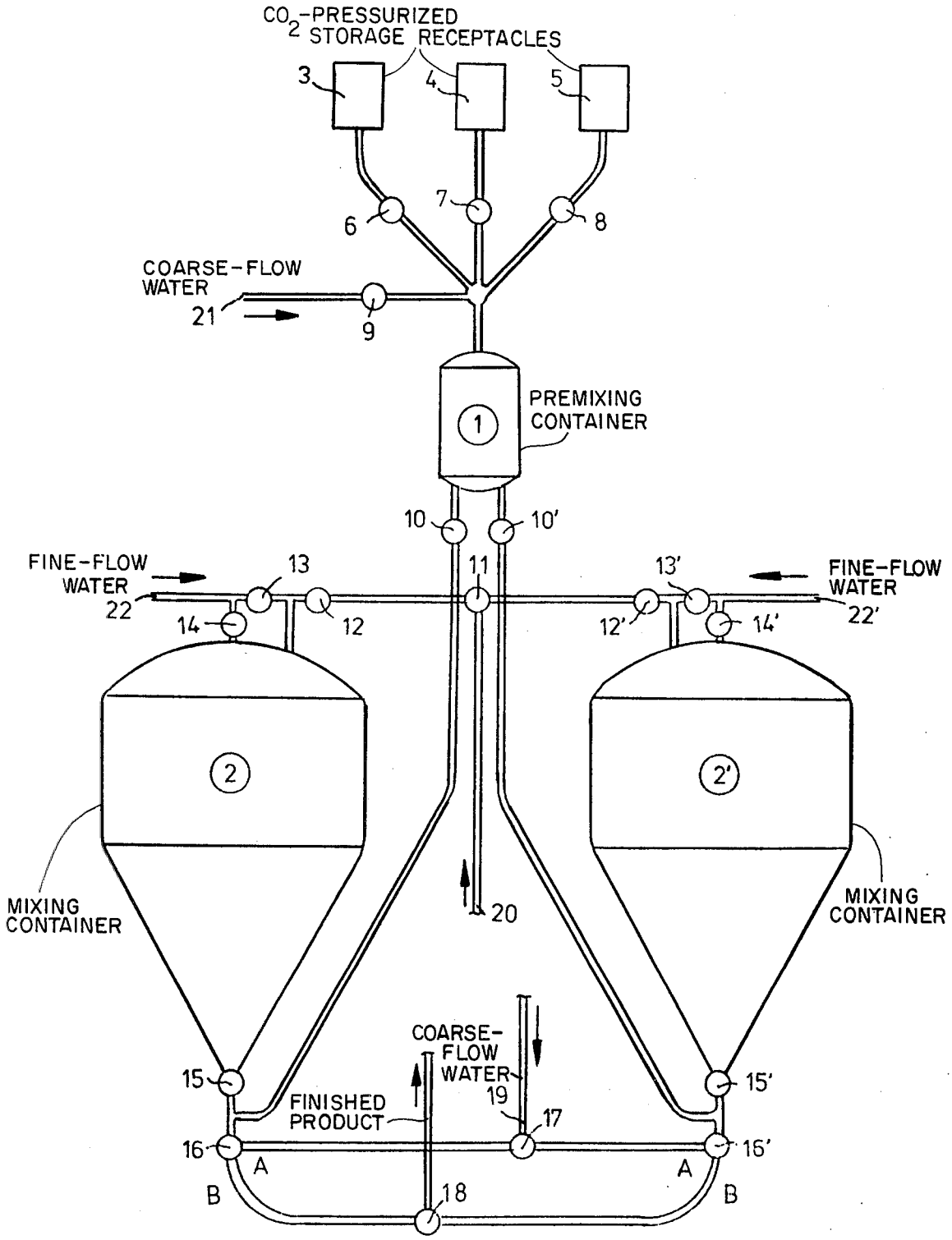
$CO_2$-PRESSURIZED STORAGE RECEPTACLES
3
4
5
6
7
8
COARSE-FLOW WATER
21
9
PREMIXING CONTAINER
1
10
10'
FINE-FLOW WATER
22
13
14
12
11
13'
12'
14'
FINE-FLOW WATER
22'
2
2'
MIXING CONTAINER
MIXING CONTAINER
20
COARSE-FLOW WATER
19
FINISHED PRODUCT
17
15
15'
16
16'
A
A
B
B
18

METHOD OF PREPARING LIQUID MIXTURES OF PREDETERMINED COMPOSITION

This application is a continuation of Ser. No. 353,723 filed Apr. 23, 1973, now abandoned.

The present invention relates to a method of preparing liquid mixtures of predetermined composition, and particularly beverages, in which the components are dosed by means of a dosing or metering device operating on a weight basis. Such methods serve for the hygienic preparation of liquid mixtures having a composition which is constant from one batch to the next. In this connection a high accuracy of the composition must be maintained since, for instance, the quality of the beverage is dependent to a considerable extent on the accuracy of its composition, and therefore exact conformity with the recipe.

In the known methods for the preparation of beverages, for instance refreshment drinks and other liquid mixtures which have a strongly predominant content of water as compared with the other components, the so-called beverage syrup is first of all prepared. The syrup consists essentially of a sugar solution, fruit acid, essences and base substances with which de-aerated water is admixed. This mixture can possibly be charged with $CO_2$.

It has been found that it is advisable to use dosaging devices operating a weight basis both for the individual components upon the preparation of the beverage syrup and upon the mixing thereof with the other components, including the required quantity of water ("Monatsschrift fur Brauerei," 24, p. 186–189, 1971). By this method of operation, one can obtain a high degree of accuracy more easily, than with devices which operate on a volume basis and furthermore, the different substances do not come into contact with the measuring devices, as is necessarily the case in methods which operate on a volume basis.

In the known methods, the necessity of using stirring devices in the mixing containers and pumps for the conveying of the components constitutes a disadvantage. With both of them, problems as to material and cleaning arise.

The object of the present invention is to circumvent these difficulties. In accordance with the invention, this is done by first evacuating the mixing container to a pressure of less than 0.5 atm. abs., whereupon the individual components of the liquid mixture are drawn through valves controlled by the dosing or metering device one after the other into the mixing container from storage containers which are under a higher pressure than the mixing container.

Since the conveying of the individual liquids to the mixing container is effected by the pressure difference between storage and mixing containers, no equipment such as delivery pumps or the like is required in the apparatus for carrying out the method of the invention. Their function is taken over by the vacuum pump which is in any event present for the required degasification of the water used. In this way there is obtained the advantage that not only are conveying means saved, but in continuous operation the cleaning of the apparatus is considerably simplified and facilitated.

When working with components of high vapor pressure, for instance in the preparation of beverages having a vapor pressure at ambient temperature higher than the vapor pressure of water, the components and/or the mixture are preferably cooled in such manner that the vapor pressure of each of the components is below the pressure in the mixing container. In this way the evaporation of substantial portions of low-boiling components in the mixing container can be avoided.

In the preparation of many liquid mixtures, for instance pharmaceutical products, the apparatus for the preparation must not only be cleaned after every batch, but must also be made sterile by means of steam conducted through the system. In accordance with a further feature of the method of the invention, the steam for the sterilization can be utilized for producing the vacuum in the mixing container. This can be done in simple fashion in the manner that, after the air has been replaced in whole or in part by steam in the mixing container, the mixing container is closed and thereupon cooled, the vacuum resulting in the container from contraction of the vapor is used for drawing in the mixture components.

The cooling of the mixing container can be effected in any desired manner. For instance, by the dissipation of heat to the surroundings by convection and radiation, there is first obtained a slight cooling which is followed by a further cooling and condensation of vapor in the mixing container by the drawing in of a part of the water necessary for the preparation of the mixture. A rapid cooling and thus also a rapid production of the vacuum in the mixing container is obtained by distributing this water in finely divided form therein, for instance by drawing it in through spray heads.

After preparation of the liquid mixture, it can be cooled. After filling of one container, the dosing device can then be utilized for the preparation of a liquid mixture in another mixing container. In this connection it is immaterial whether similar or different liquid mixtures are prepared in the mixing containers which are operated alternately. Only a suitable programming of the electronic dosing controls is required for this. They can also be used without difficulty for automatically switching from one mixing container to the other and for carrying out the switching tasks corresponding to the instantaneous conditions of the mixing containers (empty, full, etc.).

In many liquid mixtures, for instance beverages, the proportions by weight of different components in the mixture which consists predominantly of water are relatively small. In the preparation of such liquid mixtures, it is advantageous to employ the method of the invention twice by premixing the components of smaller weight proportion in a first mixing container and preparing the final liquid mixture in a second mixing container, the first mixing container taking the place of a storage container.

In accordance with a further development of the invention, those components which constitute the smaller proportion by weight and which can be premixed, for instance, in a first mixing container are first introduced into the second mixing container in which the final liquid mixture is prepared, while thereafter the larger-proportion component, consisting generally of water, is introduced.

Several inlet openings for this component are advantageously provided on the mixing container and so arranged and dimensioned that the entrance of this component effects a strong eddying of the mixture, so that a homogeneous liquid mixture is obtained. If the large component is water, as in most cases, a part of this water is advantageously introduced through the system of the feedlines of the other components in such a manner that traces of the smaller components remaining in these passages are washed into the mixing container.

One embodiment of an apparatus for carrying out the method of the invention is shown diagrammatically in the sole FIGURE of the accompanying drawing.

The smaller-proportion components are premixed in the first mixing container 1 and the final liquid mixture, i.e. the finished product, is prepared in the second mixing container 2 and/or 2'.

Before the final mixing can commence, at least the mixing container which is to be placed in operation first must be evacuated. The first mixing container 1 and the second mixing container 2 and/or 2' are preferably evacuated in a single operation. For the induction by suction of the individual components of the liquid mixture to be prepared, a pressure (suction) of 0.5 atm. abs. in the mixing container is generally sufficient. If readily volatile components are to be used, it may be advisable, in order to obtain high speeds of delivery, to place the storage containers under pressure instead of using a correspondingly reduced pressure in the mixing container. This measure frequently does not result in any additional technical expense, since the components which are used are stored in their storage containers under a $CO_2$ atmosphere in order, for instance, to protect them from oxidation.

Upon the starting up of the apparatus shown, the vacuum pump (not shown) commences operation and for instance, via the line 19 which is provided also for the supplying of water and the valves 16, 16', 17 and the outlets 15, 15', can be connected to the mixing containers 1, 2 and 2', the outlets 10 and 10' being open. After the vacuum predetermined for the mixing container 1 has been reached or after a time of pumping which can be determined, for instance by a time relay, the outlets 10 and 10' are closed.

If a report is obtained that the mixing containers 2 and 2' are empty, the outlets 15 and 15' of the mixing containers 2 and 2' as well as the valve 9 are closed. The valves 16 and 16' are in position A.

The mixing of the small weight components which are present in the storage containers 3, 4 and 5 is now effected in the mixing container 1 in the manner that first a valve associated with one of said storage containers, for instance the valve 6, opens. After the predetermined quantity of liquid present in the storage container 3 has passed into the mixing container 1, the valve 6 closes, the valve 7 opens, and liquid is added from the storage container 4. The addition of liquid from the storage container 5 proceeds in corresponding fashion via the valve 8 which is controlled by the closing device in the same manner as the valves 6 and 7.

The mixing process in the mixing containers 2 and/or 2' can start simultaneously with the mixing in the mixing container 1 by supplying via line 20 an additional component into the mixing container 2 via the valve 11, for instance, with valve 12 open. After the premix has been prepared in the mixing container 1, the small components by weight contained therein can be brought into the mixing container 2 and/or 2' by opening the outlets 10 and/or 10'.

Finally, the component which constitutes the largest proportion in weight, namely the water, is added. It is first fed in a coarse stream from the line 21 via the valve 9 and the outlet 10 or 10' into the mixing containers 2 and 2' via the outlet 15 or 15' and from the line 19 via the valve 17 and the valve 16 or 16'. This coarse stream of water produces an intense mixing and washes all traces of liquid out of the lines leading from the valves 6, 7 and 8 to the mixing container 1, the container itself, and the lines and valve connecting it with the mixing containers 2 and 2'.

The precise dosaging of the quantity of water to be added is effected via the lines 13 and 14 or 13' and 14' respectively. The finished product obtained is to be bottled via the outlet 15 or 15' of the valve 16 or 16' which is in position B and the valve 18 after the product has possibly been charged with $CO_2$.

We claim:

1. A method of preparing a beverage consisting predominantly of water and including a plurality of other components, said method comprising the steps of:

a. metering quantities of each of said other components by weight into respective storage receptacles and pressuring each of said storage receptacles with $CO_2$;

b. evacuating a premixing container and a mixing container simultaneously to a pressure of at most 0.5 atm. abs.;

c. successively communicating at least two of said storage receptacles with said premixing container to induce the respective components to pass by suction from said storage receptacles into said premixing container;

d. connecting said premixing container to said mixing container to induce by suction the contents of said premixing container to empty into said mixing container;

e. thereafter drawing water by the suction in said mixing container into the latter and at least in part through said premixing container for mixture with said components in said mixing container; and f. discharging the mixture of said components with water from said mixing container.

* * * * *